United States Patent [19]

Burr

[11] Patent Number: 4,498,879

[45] Date of Patent: Feb. 12, 1985

[54] EMERGENCY RESCUE DEVICE

[75] Inventor: J. Kelsey Burr, Jupiter, Fla.

[73] Assignee: Halkey-Roberts Corporation, St. Petersburg, Fla.

[21] Appl. No.: 462,213

[22] Filed: Jan. 31, 1983

[51] Int. Cl.[3] ..... B63C 9/22

[52] U.S. Cl. ..... 441/80; 441/88; 441/89; 441/94; 441/28

[58] Field of Search ..... 114/190; 441/80, 81, 441/84, 85, 88, 89, 94, 95, 6, 11, 18, 28, 30

[56] References Cited

U.S. PATENT DOCUMENTS

| | | | |
|---|---|---|---|
| 2,264,321 | 12/1941 | Manson | 441/80 X |
| 3,754,291 | 8/1973 | Harris | 114/190 X |
| 3,997,079 | 12/1976 | Niemann | 441/95 |

*Primary Examiner*—Sherman D. Basinger
*Attorney, Agent, or Firm*—Stefan Stein

[57] ABSTRACT

An emergency rescue assembly comprising a container attachable to a boat so as to overhang the water, with an automatically inflatable location or flotation device stored in the container. The container is readily opened by a pull on a release so that the device falls into the water and automatically inflates.

7 Claims, 12 Drawing Figures

EMERGENCY RESCUE DEVICE

BACKGROUND OF INVENTION

This invention relates to emergency devices to assist in the rescue of persons who have fallen overboard in deep water. In particular the invention relates to location and flotation devices which can be deployed into the water immediately after the emergency is discovered.

Prior art emergency location and flotation devices have one or more disadvantages such as difficulty of mounting on a ship, time consuming deployment, excessive weight and poor visibilty.

One object of the present invention is to provide a compact readily mountable emergency location and flotation device which can be readily and reliably deployed.

Other objects and advantages of this invention will be apparent from the description and claims which follow, taken together with the appended drawings.

SUMMARY OF INVENTION

The invention comprises broadly an assembly of an inflatable location or flotation device in a container mounted on the deck of a ship. The container has a front flap which is releasably secured to the walls of the container. A pull on a strap attached to the flap opens the container and permits the stored device to fall into the water. Means are provided to automatically inflate the devices with a gas under pressure, as for example, carbon dioxide.

In its preferred form, the container holds both an inflatable location device and an inflatable personal flotation devices which are tethered together. In addition, it is preferred that identification and signal devices be included, as for example, a strobe light, air horn, whistle, flares, dye marker, distress flag, radar reflector panels, helium balloon and sea anchor. Where appropriate such identification and signal devices may also be tethered to the inflatable devices.

In its preferred form the container is attached by straps to the rail on the deck of a ship. A release strap extends from the bottom of the front flap to the top of the container where it is connected to a line attached to the deck. Thus, a pull on the line immediately pulls up the front flap permitting the stored devices to fall into the water. The front panel is preferably releasably attached, as for example, with the fastener sold under the trademark "Velcro", to an upward skirt extension of the bottom panel. When the front flap is pulled up, the skirt and bottom panel drop down to deploy the contents of the container. A metal snap between the front panel and the skirt insures that the container will not open accidentally but only when there is sufficient pull.

The inflatable location device is preferably a signal cone with a weight in the bottom to keep it vertical when inflated. Inflation of the devices is accomplished by releasing gas stored under pressure. Such release is accomplished either by the action of the water on the release mechanism or by mechanical release triggered by the pull on lines attached to the container as the contents fall into the water. In the latter instance, for example, a spring loaded puncture pin is driven into the opening of the vessel under pressure, thus permitting inflation. The driving is accomplished by a pivoted arm one end of which is connected to the container. As the devices fall the pull causes the arm to pivot and then fall away. The inflation thus starts before the devices hit the water. Water-soluble releases can also be used since they are activated immediately upon striking the water.

SPECIFIC EXAMPLES OF INVENTION

Figure 1:
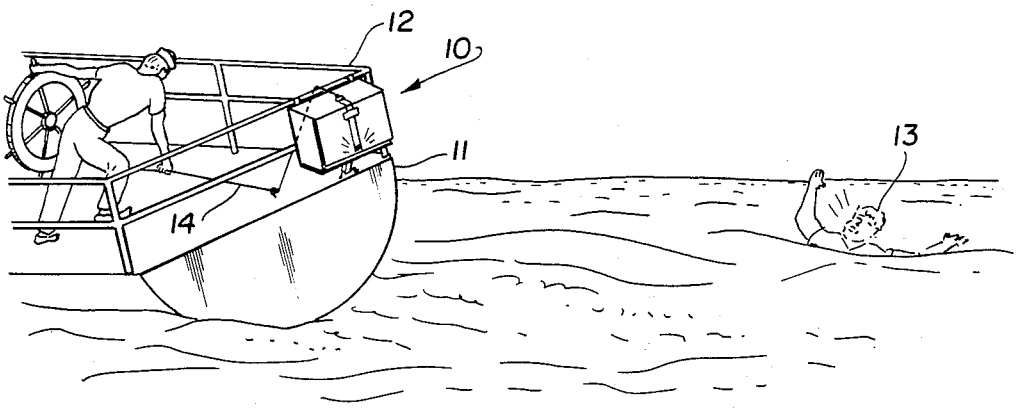
FIG. 1 is a view showing the container with stored flotation devices mounted on the rail of a boat and with its release line attached to the deck.

Referring now to the drawings a preferred embodiment 10 of this invention is shown attached to the rail 12 of vessel 11 with straps 97 and 98. The container 100 comprises a back wall 100*a* vertically attached to two side walls 100*b*. A top wall 100*c* has a foldable, flexible front extension 100*d*. Extending from the bottom of back wall 100*a* is a bottom panel 102 attached only along one edge and having a foldable skirt extension 103*a* provided with a fastener means 102*b*, as for example, the fastener sold under the trademark Velcro. Front flexible panel 100*d* has cooperating fastening means 100*dd*. Panel 100*d* also has an external metal snap 102*a* to which is attached strap 100*f* extending through loop 109 to ring 101 attached to release line 14 which in turn is held on the deck 96 of the vessel. Pulling on the release line 14 causes the flexible front panel 100*d* to be separated from the skirt 103*a* and pulled up.

The skirt with the bottom panel 102 drops back and down and the contents of the container drop down to the water in a very rapid fashion.

Stored within the container is a collapsed inflatable horseshoe flotation device 111, a collapsed inflatable signal cone 104, a weight 105 in the signal cone, carbon dioxide storage means 301 and carbon dioxide valve release means 300 associated with said carbon dioxide storage means. The signal cone and horseshoe flotation device are tethered together with lines 109 and 110.

Also stored in the container are other rescue devices such as an air horn, whistle, dye marker, aerial flare, mini strobe light, signal light and personal light. Associated with the inflatable cone is a signal flag 108, a water-activated light 120, reflective panels 121 and a drogue 119. The container is preferably made with a vacuum-formed plastic inner liner covered with nylon pack cloth.

Figure 2:
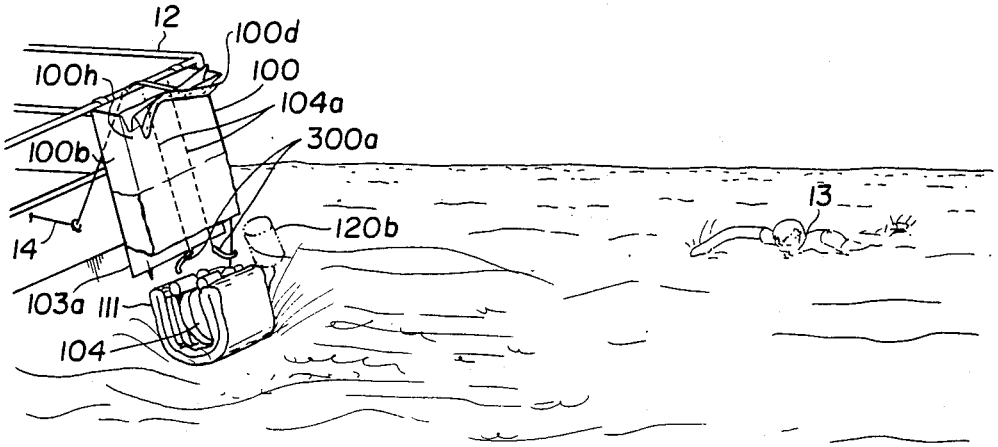
FIG. 2 shows the same view as FIG. 1 after the devices have been dropped from the container.
Figure 3:
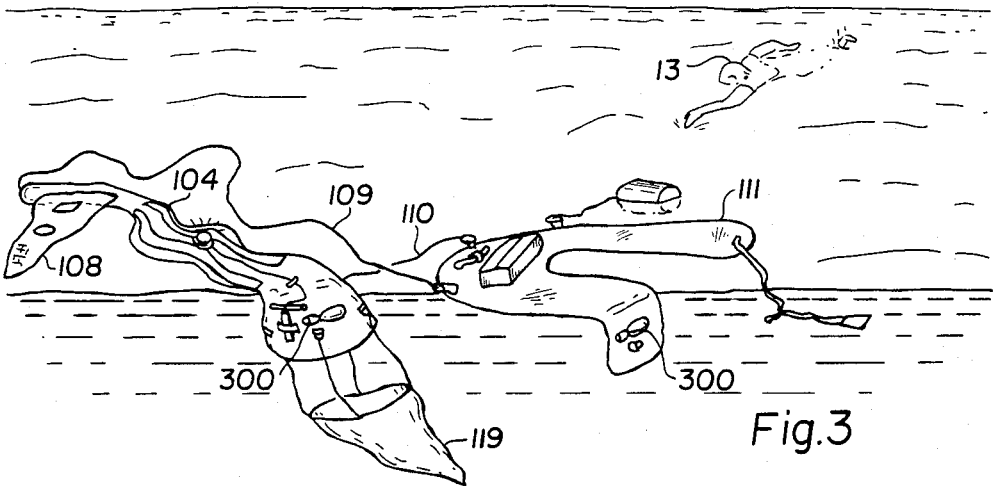
FIG. 3 shows the devices partially inflated on the surface of the water.
Figure 4:
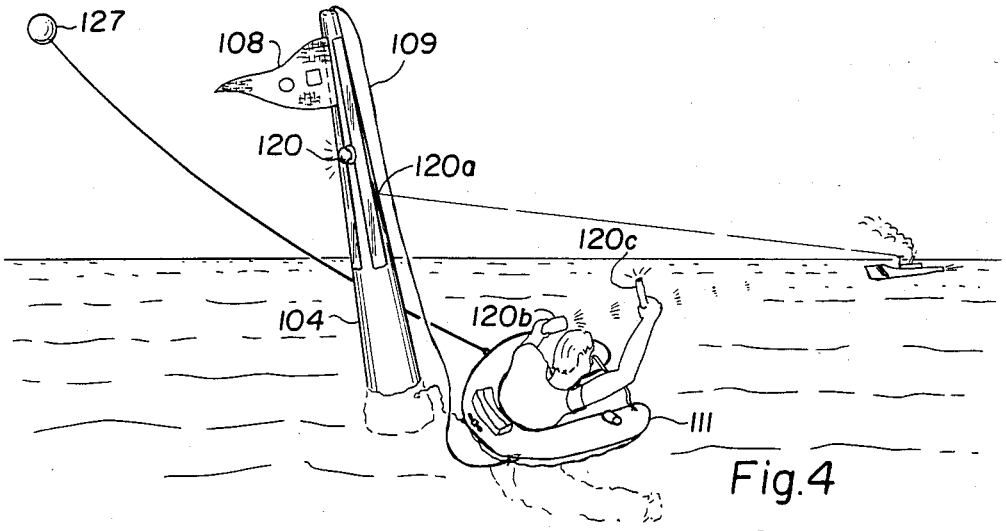
FIG. 4 shows the devices fully inflated with the survivor in position on the horseshoe.
Figure 5:
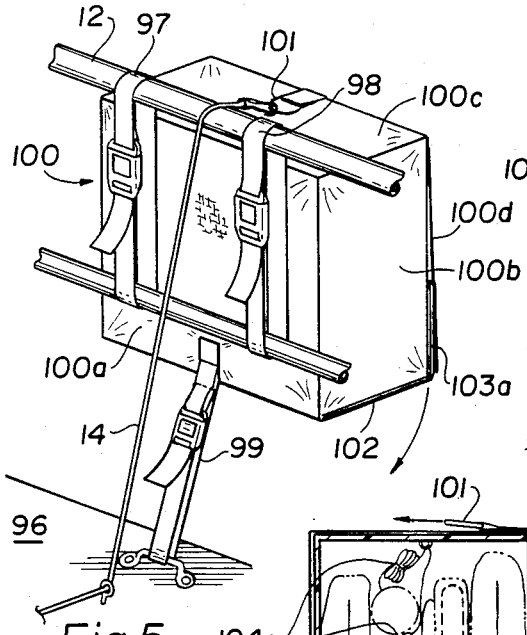
FIG. 5 is a partial perspective view of a preferred form of the invention in stowed condition mounted on the rail of a boat with its release line attached to the deck.
Figure 6:
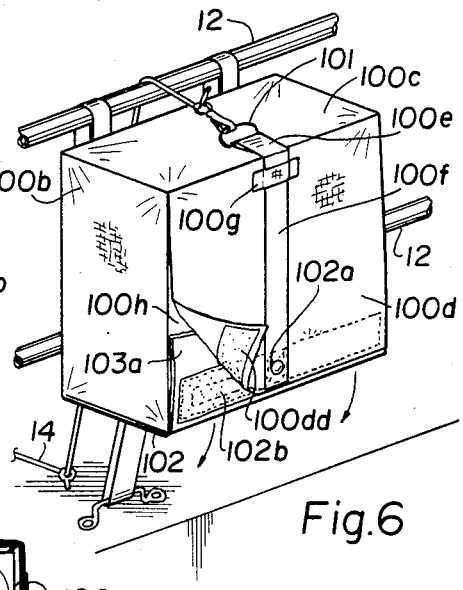
FIG. 6 is an opposite perspective view of FIG. 5 showing the attachment of the front panel to the skirt extension of the bottom panel.
Figure 7:
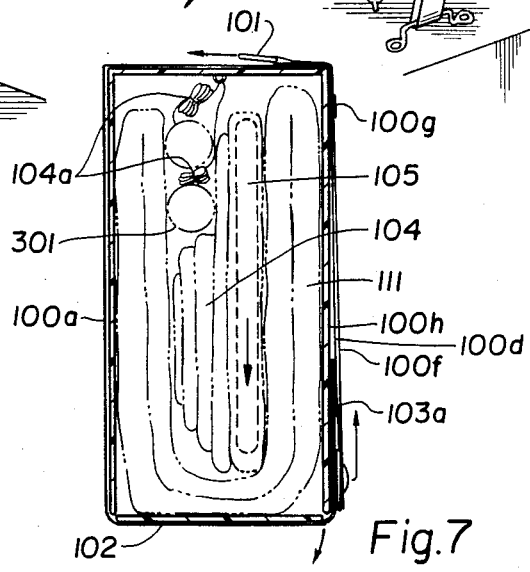
FIG. 7 is a schematic cross section along line 7—7 of FIG. 6 showing the packing of the inflatable devices in the container.
Figures 8, 9:
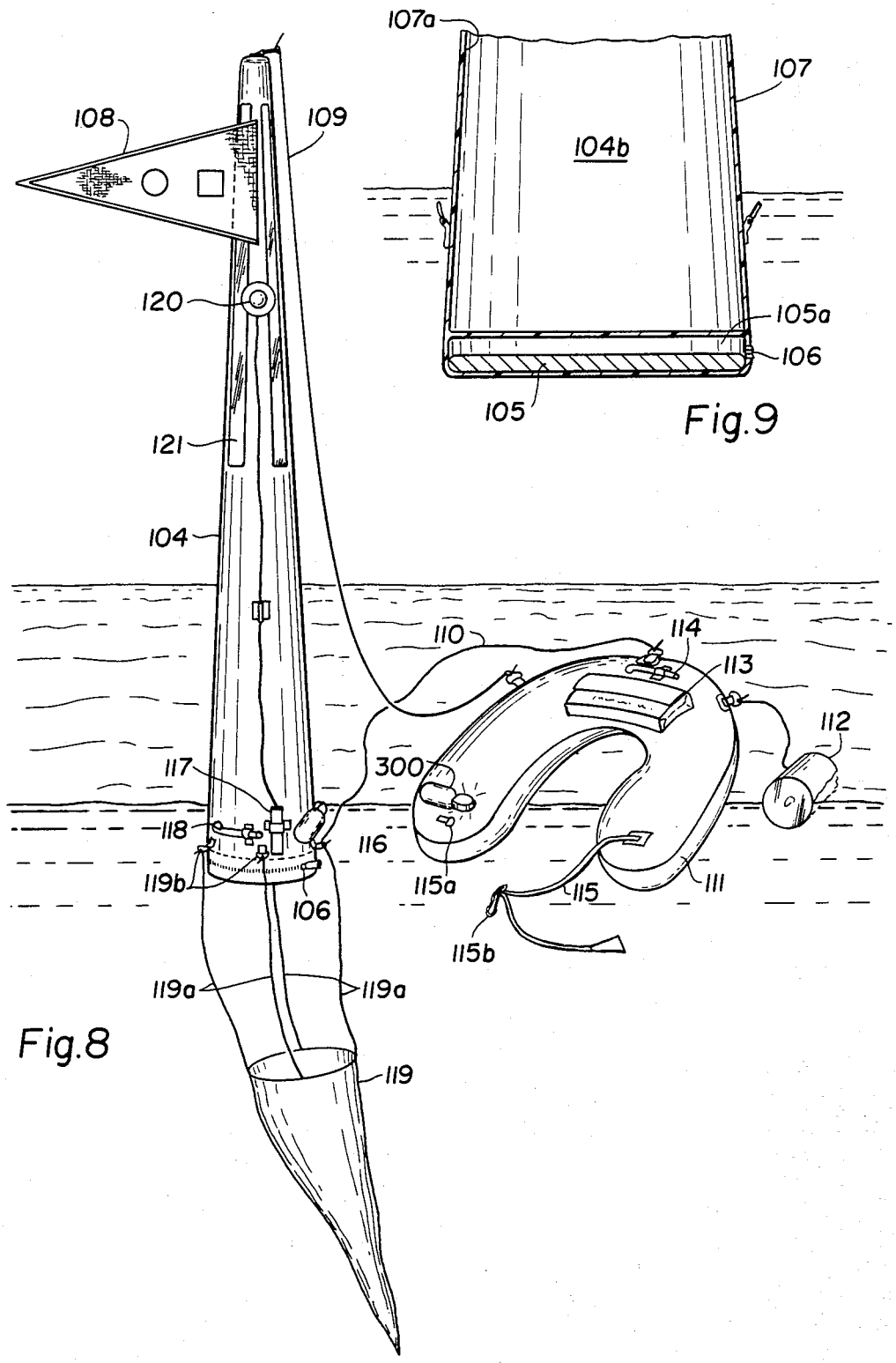
FIG. 8 is an enlarged detailed view of the fully-inflated tethered devices in the water.
FIG. 9 is a partial section along line 9—9 showing the bottom portion of the signal cone.
Figure 11:
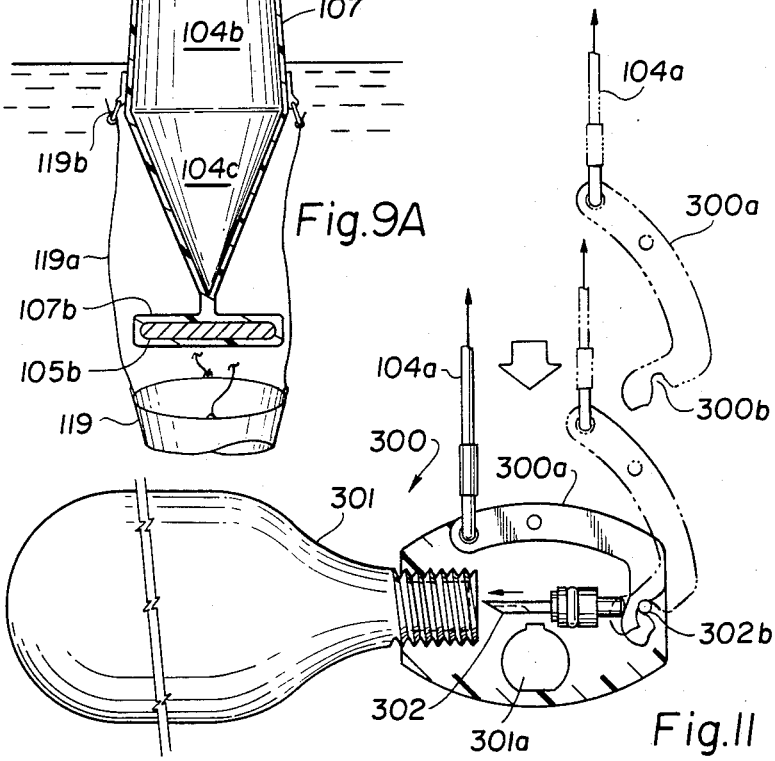
FIG. 11 is a schematic section showing the mechanism for mechanically releasing the gas under pressure.

When the release line 14 is pulled the contents of the container 100 immediately fall out and the inflatable cone and horseshoe flotation device are automatically inflated as illustrated more particularly in FIGS. 2 and 3. As shown in FIG. 11, lanyards 104*a* are attached to cam-shaped levers 300*a* having cut-out 300*b* which mount on pivot 302*b*. When the contents are dropped out of the container the cam-shaped levers 300*a* rotate so as to drive puncture pin 302 into the carbon dioxide reservoir 301 and then separate from the pivot 302*b*. Inflation thus begins while the cone and horseshoe device are still falling.

Figure 10:
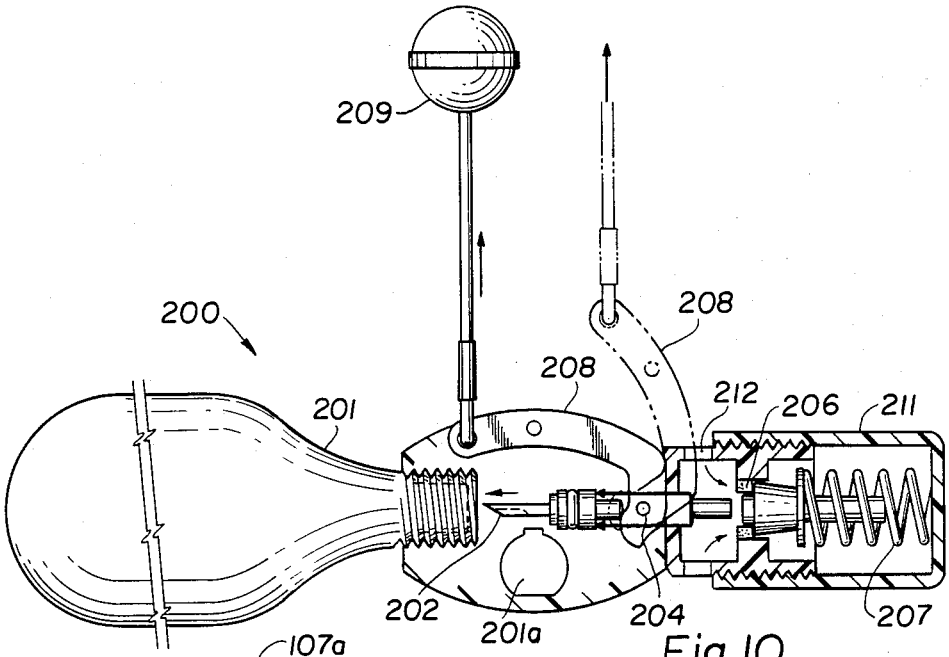
FIG. 10 is a schematic section showing the operation of the water soluble release mechanism for inflating with gas under pressure.

An alternative method of automatic inflation is to use as illustrated in FIG. 10 a water-soluble release which permits spring 207 to drive puncture pin 202 into carbon dioxide container 201, utilizing a fixed cam lever 203. Both devices have as a safety a manual activator 209 in the event that the automatic inflation fails.

Signal cone 104 when inflated sits vertically in the water. Its weight compartment 105*a* has a zipper 106 for insertion of weight 105 and is separated from the carbon dioxide compartment. The cone 104 is preferably neoprene-coated nylon 107 with aluminized mylar coating 107*a* for radar reflection. It has connections 119*b* for lines 119*a* holding stabilizing sea anchor 119. A light 120 is mounted in the upper end and makes the reflective panels 121 visible. Power for the light 120 is provided by a water-activated battery 117. Signal flag 108 is mounted near the top of the cone. A manual inflation tube 118 is provided.

The horseshoe flotation device also has a manual inflation tube 114, a pocket 113 for ancillary devices, and a line 115 which connects the snap 115*b* to snap 115*a* to hold the survivor 13 within the flotation device. Among the ancillary devices are a helium balloon 127, a strobe light 120*b* and a flare 120*c*.

Figure 9A:
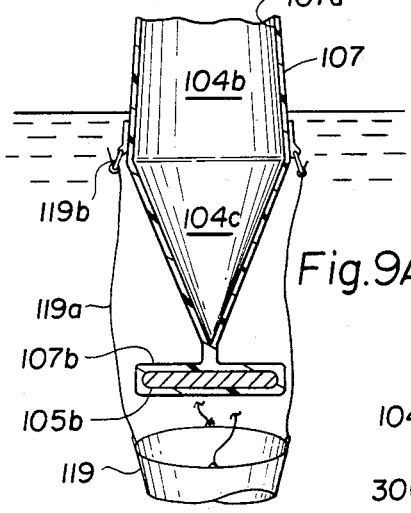
FIG. 9A is a partial section showing an alternate construction of the signal cone.

An alternative structure for anchoring the signal cone, as illustrated in FIG. 9A, is to form the bottom of the inflation chamber 104*a* as an inverted cone 107*b* terminating in chamber 107*b* containing a lead weight 105*b*.

I claim:

1. An emergency rescue assembly for deployment from a boat to rescue a person in a body of water comprising in combination:

a container including side walls and a top wall fixed together to define an open ended bottom;

said container further including a bottom panel adapted to be closed over said open ended bottom;

means for releasably securing said bottom panel over said open ended bottom;

means for attaching said container to the vehicle in an overhanging position above the body of water;

an inflatable personal flotation device stored within said container;

first means for automatically inflating said personal flotation device;

an inflatable signal cone comprising an elongated cone-shaped air-filled bladder capable of remaining erect upon inflation and a weight disposed at the bottom end thereof for maintaining said signal cone in an upright position in the body of water upon inflation of said bladder;

second means for automatically inflating said signal cone;

a sea anchor;

first tether means connecting said sea anchor to said personal flotation device or to said signal cone; and second tether means connecting said personal flotation device and said signal cone together, whereby, upon actuation of said securing means, said bottom panel falls open, said personal flotation device and said signal cone fall directly from within said container into the body of water, and both said inflating means are actuated to inflate said personal flotation device and said signal cone after dropping from within said container.

2. The emergency rescue assembly as set forth in claim 1, wherein said second inflating means comprises in combination:

storage means containing a supply of compressed gas;

valve release means associated with said storage means and including a puncture pin operatively disposed within a body for piercing said storage means allowing the gas contained therein to flow into said signal cone;

said valve release means further including a removable cam shaped lever having a cut-out mounted on a pivot and a lanyard having one end connected to said cam-shaped lever for pivoting said cam-shaped lever about said pivot to drive said puncture pin into said storage means whereupon said cam-shaped lever is disengaged from said body; and means for connecting another end of said lanyard relative to said container, whereby said second inflating means is automatically actuated to begin inflation of said signal cone after said signal cone has exited said container.

3. The emergency rescure assembly as set forth in claim 1, wherein said first inflating means comprises in combination:

storage means containing a supply of compressed gas;

valve release means associated with said storage means and including a puncture pin operatively disposed within a body for piercing said storage means allowing the gas contained therein to flow into said personal flotation device;

said valve release means further including a removable cam shaped lever having a cut-out mounted on a pivot and a lanyard having one end connected to said cam-shaped lever for pivoting said cam-shaped lever about said pivot to drive said puncture pin into said storage means whereupon said cam-shaped lever is disengaged from said body; and means for connecting another end of said lanyard relative to said container, whereby said first inflating means is automatically actuated to begin inflation of said personal flotation device after said personal flotation device has exited said container.

4. The emergency rescue device as set forth in claim 1, wherein said weight is disposed within a weight compartment affixed to the bottom of said bladder.

5. The emergency rescue device as set forth in claim 4, wherein said weight compartment includes an access opening for allowing said weight to be removed therefrom.

6. The emergency rescue device as set forth in claim 4, wherein the bottom of said bladder includes an inverted cone shape and wherein said weight compartment is fixed to the apex of said inverted cone shape.

7. The emergency rescue device as set forth in claim 1, wherein said securing means comprises a flexible skirt extension affixed to said bottom panel, a flexible front extension affixed to said top well, fastener means removably fastening said front extension and said skirt extension together, a loop affixed to the upper portion of said front extension, and a strap having a first end affixed to the lower podion of said front extension and a second end extending through said loop, whereby, upon pulling of said second end of said strap, said strap unfastens said front extension from said skirt extension to then allow said skirt extension and said bottom panel to fall downwardly to an open-ended position exposing the open-ended bottom of said container.

* * * * *